US012326319B2

(12) United States Patent
Danzinger et al.

(10) Patent No.: US 12,326,319 B2
(45) Date of Patent: Jun. 10, 2025

(54) CHEMICAL IRRITANT SPRAY ASSEMBLY THAT ATTACHES TO A HANDGUN

(71) Applicant: Brodan LLC, Surfside, FL (US)

(72) Inventors: Shlomo Danzinger, Surfside, FL (US); Levi Danzinger, Miami, FL (US)

(73) Assignee: Brodan LLC, Surfside, FL (US)

( * ) Notice: Subject to any disclaimer, the term of this patent is extended or adjusted under 35 U.S.C. 154(b) by 0 days.

(21) Appl. No.: 18/491,721

(22) Filed: Oct. 20, 2023

(65) Prior Publication Data

US 2024/0044612 A1 Feb. 8, 2024

Related U.S. Application Data

(63) Continuation-in-part of application No. 17/737,944, filed on May 5, 2022, now Pat. No. 11,808,549.

(60) Provisional application No. 63/188,438, filed on May 13, 2021.

(51) Int. Cl.
*F41C 27/00* (2006.01)
*F41H 9/10* (2006.01)

(52) U.S. Cl.
CPC ..... *F41C 27/00* (2013.01); *F41H 9/10* (2013.01)

(58) Field of Classification Search
CPC ..... F41H 9/10; F41C 27/06; F41C 27/00
See application file for complete search history.

(56) References Cited

U.S. PATENT DOCUMENTS

| | | | | |
|---|---|---|---|---|
| 1,269,922 | A * | 6/1918 | Gadecki | B05B 11/1074 222/386 |
| 1,333,268 | A | 3/1920 | Masiates | |
| 2,124,172 | A | 7/1938 | Wildes et al. | |
| 3,109,253 | A | 11/1963 | Eig | |
| 3,298,125 | A | 1/1967 | Adrian et al. | |
| 3,374,708 | A | 3/1968 | Wall | |
| 3,619,930 | A | 11/1971 | Beermann et al. | |
| 3,706,151 | A | 12/1972 | McNeill | |
| 3,707,793 | A | 1/1973 | Holtor, II | |
| 3,733,727 | A | 5/1973 | Jones et al. | |
| 3,841,526 | A | 10/1974 | Haskins | |
| 3,956,843 | A | 5/1976 | Litman | |
| 4,058,921 | A | 11/1977 | Mason | |

(Continued)

FOREIGN PATENT DOCUMENTS

DE 1915045 10/1970

*Primary Examiner* — Joshua E Freeman
(74) *Attorney, Agent, or Firm* — LaMorte & Associates P.C.

(57) ABSTRACT

A device that attaches to a handgun that selectively dispenses material from a pressurized canister. The device defines an internal chamber of a first length that is sized to receive the pressurized canister. A nozzle is disposed at a first end. The pressurized canister is selectively biased against the spray nozzle by being displaced within the canister chamber by a cam. The cam moves from a first position outside the internal chamber to a second position at least partially inside the internal chamber. The cam is mounted on an axle. The axle has finger levers mounted to the ends of the axle. When a finger lever is depressed, the axle turns, and the cam rotates into the internal chamber. The cam contacts the pressurized canister and displaces the pressurized canister forward against the spray nozzle. This releases the contents of the pressurized canister through the spray nozzle.

5 Claims, 7 Drawing Sheets

(56) References Cited

U.S. PATENT DOCUMENTS

| | | | | | |
|---|---|---|---|---|---|
| 4,316,388 | A | | 2/1982 | Mason et al. | |
| 4,777,754 | A | | 10/1988 | Reynolds, Jr. | |
| 5,088,624 | A | | 2/1992 | Hackett et al. | |
| 5,225,623 | A | | 7/1993 | Krasnow | |
| 5,397,029 | A | | 3/1995 | West | |
| 5,473,501 | A | | 12/1995 | Claypool | |
| 5,485,695 | A | | 1/1996 | Glock | |
| 5,531,359 | A | | 7/1996 | Winner | |
| 5,581,898 | A | | 12/1996 | Thummel | |
| 5,671,559 | A | * | 9/1997 | Ludaesher | F41B 9/00 42/1.08 |
| 5,787,628 | A | * | 8/1998 | Teetzel | F41C 27/00 42/1.08 |
| 5,983,548 | A | * | 11/1999 | Ludaescher | F41H 9/10 42/1.08 |
| 6,050,454 | A | * | 4/2000 | Ludaescher | F21V 33/0064 222/162 |
| 6,546,661 | B1 | * | 4/2003 | Staubs | F41H 9/10 42/1.08 |
| 8,510,979 | B1 | * | 8/2013 | Mortimer | F41G 1/35 42/114 |
| 9,170,073 | B2 | * | 10/2015 | Mangold | F41C 27/00 |
| 2014/0048561 | A1 | * | 2/2014 | Mangold | F41H 9/10 222/79 |

* cited by examiner

CHEMICAL IRRITANT SPRAY ASSEMBLY THAT ATTACHES TO A HANDGUN

RELATED APPLICATIONS

This application is a continuation-in-part of U.S. patent application Ser. No. 17/737,944, filed May 5, 2022, which claims the priority of U.S. Provisional Patent Application No. 63/188,438, filed May 13, 2021.

BACKGROUND OF THE INVENTION

1. Field of the Invention

In general, the present invention relates to accessories that attach to a handgun. More particularly, the present invention relates to attachments that contain and spray chemical irritants when activated.

2. Prior Art Description

Law enforcement officers, and many civilians, have equipment and training to react to both life threatening and non-life threatening situations. For example, many law enforcement officers are issued handguns that should only be used if the life of the officer or the life of another is in immediate danger. These same law enforcement officers may also be issued a Taser® or chemical irritant spray for use if a threat is not life threatening. The problem is that a person can change between being a threat and a non-threat, and vice versa, in an instant. There are many scenarios when a subject presents a threat with a melee weapon such as a knife, hammer, screwdriver crowbar, or the like. While the subject may not present themselves as an immediate threat, such as a person with a firearm would, the situation can escalate in an instant. A subject with a knife who is within 21 feet of an armed person can typically reach the armed person before the armed person has time to draw their weapon.

It is for this reason that law enforcement officers and trained civilians assume that any person with a melee weapon presents a danger. Accordingly, the person with the weapon is often approached with the officer's weapon drawn. Once the weapon is drawn, it is difficult for an officer to utilize the non-lethal systems they may be carrying. To address this problem, systems have been made that enable a canister of chemical irritant to be attached directly to the officer's firearm. In this manner, a law enforcement officer can approach a situation ready to use the handgun and quickly change to the chemical spray irritant if the situation provides a brief window of opportunity for a non-lethal response.

However, there are many problems associated with connecting a non-lethal device to a handgun. The three largest problems are those of functional integrity, safety, and situational activation.

A non-lethal device, when attached to a handgun, must preserve functional integrity. The non-lethal device cannot interfere with any action of the handgun. This includes loading, aiming, and firing. Some handguns have mounting rails that are located in front of the trigger and below the barrel. The rails are traditionally used for the mounting of flashlights or laser sites. If a non-lethal device is attached to a handgun, it must be able to attach to the mounting rails and have the ability to be activated from that position.

A non-lethal device, when attached to a handgun, must be safe. That is, the non-lethal device cannot present a danger of accidental discharge to either the non-lethal device or the handgun. In U.S. Pat. No. 9,170,073 to Mangold, a chemical spray device is mounted to a gun rail. The chemical spray device has a twist activation knob. Accordingly, to activate the chemical spray device, the user must use two hands, one hand to hold the gun and the other hand to activate the chemical spray device. This is less than optimal since the law enforcement officer may not always have both hands free to activate the chemical spray device. Furthermore, the officer would have to alter their grip on the handgun and deviate from the proper grip technique required to operate the handgun safely and effectively.

A non-lethal device, when attached to a handgun, must have situational activation. That is, the non-lethal device must be able to be activated in every situation where the handgun itself can be activated. That is, the non-lethal device must be able to be activated by one hand holding the handgun regardless of which hand is holding the handgun. Furthermore, the non-lethal device must be able to be activated with a simple finger motion and preferably a finger motion that is different from that used to fire the handgun.

U.S. Pat. No. 6,546,661 to Staubs, shows a chemical spray device that is activated by pulling a trigger. This is not optimal because the action of pulling a trigger is also the muscle action used to fire the handgun. As such, it is very possible that muscle memory could cause a person to squeeze the trigger of the handgun when intending to squeeze the trigger of the chemical spray device.

In U.S. Pat. No. 5,983,548 to Ludaescher, a chemical spray device is provided that attaches to a handgun. The device has an activation lever that must be pressed forward in use. However, the activation lever extends to only one side of the handgun. Accordingly, the device is not for ambidextrous use. Further still, in order to press the activation lever forward, the user's hand must brace and apply an equal counter pressure. As such, the hand must squeeze the handgun in order to counter the forward pressure. This squeezing action can also result in the trigger of the handgun being accidentally squeezed.

A need therefore exists for an improved chemical spray device that can be attached to a handgun and has easy ambidextrous activation capability without requiring the user to use a squeezing action in the hand. This need is met by the present invention as described and claimed below.

SUMMARY OF THE INVENTION

The present invention is a device that attaches to a handgun that can selectively dispense material from a pressurized canister. The device has a cylindrical body that mounts to the mounting rail of a handgun. The cylindrical body has a first end and a second end. The first end of the cylindrical body receives the pressurized canister and is closed with an end cap. Together the cylindrical body and the end cap define an internal chamber that retains the pressurized canister.

The end cap has a spray nozzle. The spray nozzle is positioned adjacent the dispensing valve of the pressurized canister. The spray nozzle opens the dispensing valve when the pressurized canister is biased against the spray nozzle.

The pressurized canister is selectively biased against the spray nozzle by being displaced within the canister receptacle by a cam. The cam moves from a first position outside the internal chamber to a second position at least partially inside the internal chamber. The cam is mounted on an axle. The axle has finger levers mounted to the ends of the axle. When a finger lever is depressed, the axle turns, and the cam rotates into the internal chamber. The cam contacts the pressurized canister and displaces the pressurized canister forward against the spray nozzle. This releases the contents of the pressurized canister through the spray nozzle.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
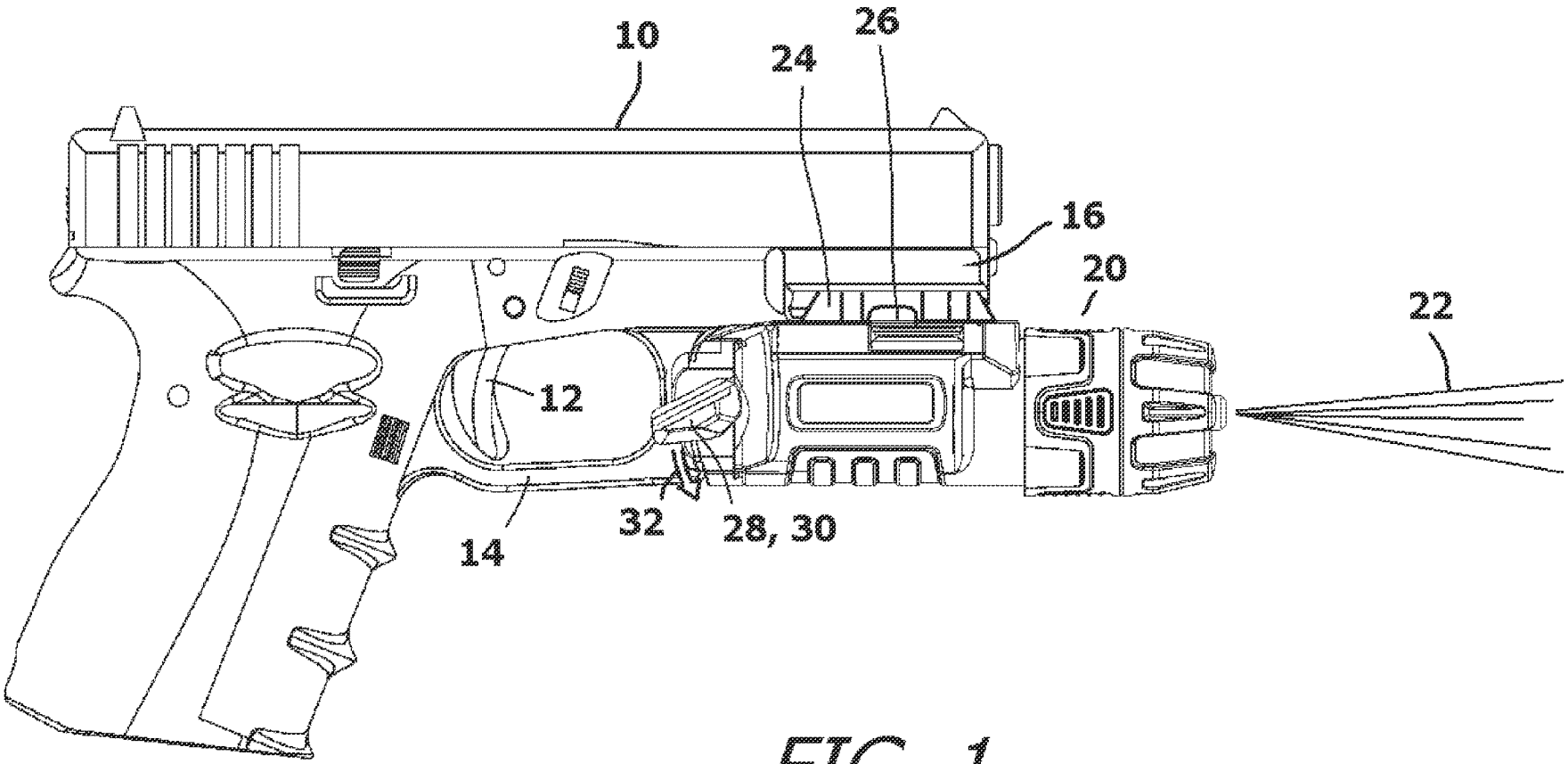
FIG. 1 is a side view of an exemplary embodiment of the present invention spray dispenser attached to the mounting rail of a handgun.

Referring to FIG. 1, an exemplary handgun 10 is shown. The handgun 10 has a trigger 12, a trigger guard 14, and an accessory mounting rail 16 that is positioned forward of the trigger guard 14. The present invention is a compact spray dispenser 20 that releases a chemical irritant 22 when activated. The chemical irritant 22 is preferably pepper spray or gel, such as Mace®. The spray dispenser 20 is compatible with many handguns and aftermarket holsters available in today's market. This includes both the Safariland® and Blackhawk® light bearing holsters, which are the standard for law enforcement and military.

The spray dispenser 20 attaches to the accessory mounting rail 16 of the handgun 10 utilizing a quick release rail mount 24. The quick release rail mount 24 has an easily accessible release mechanism 26 on both of its sides. By manually manipulating the release mechanisms 26, the quick release rail mount 24 can either engage or disengage the accessory mounting rail 16. In this manner, the entire spray dispenser 20 can be rapidly attached to, or removed from, the handgun 10 without tools.

The spray dispenser 20 has two finger levers 28, 30 that straddle the trigger guard 14. In this manner, one of the finger levers 28, 30 can be easily accessed regardless of whether the handgun 10 is being held in the left hand or the right hand. When held in one hand, the finger levers 28, 30 are positioned at the point where the law enforcement officer is trained to position his/her trigger finger when the handgun 10 is drawn. When held with two hands, the finger levers 28, 30 are designed to be activated by the user's thumb. When the handgun 10 is properly gripped in a two-hand method, the thumb is positioned directly adjacent one of the finger levers 28, 30. The finger levers 28, 30 are positioned outside the trigger guard 14. As will be explained, the finger levers 28, 30 will activate the spray dispenser 20 only when one of the finger levers 28, 30 is pushed down in the direction of arrow 32. The finger levers 28, 30 do not activate the spray dispenser 20 when pressed directly toward the handgun 10. In this manner, contact with a holster, when holstering the gun, will not inadvertently activate the spray dispenser 20.

Figure 2:
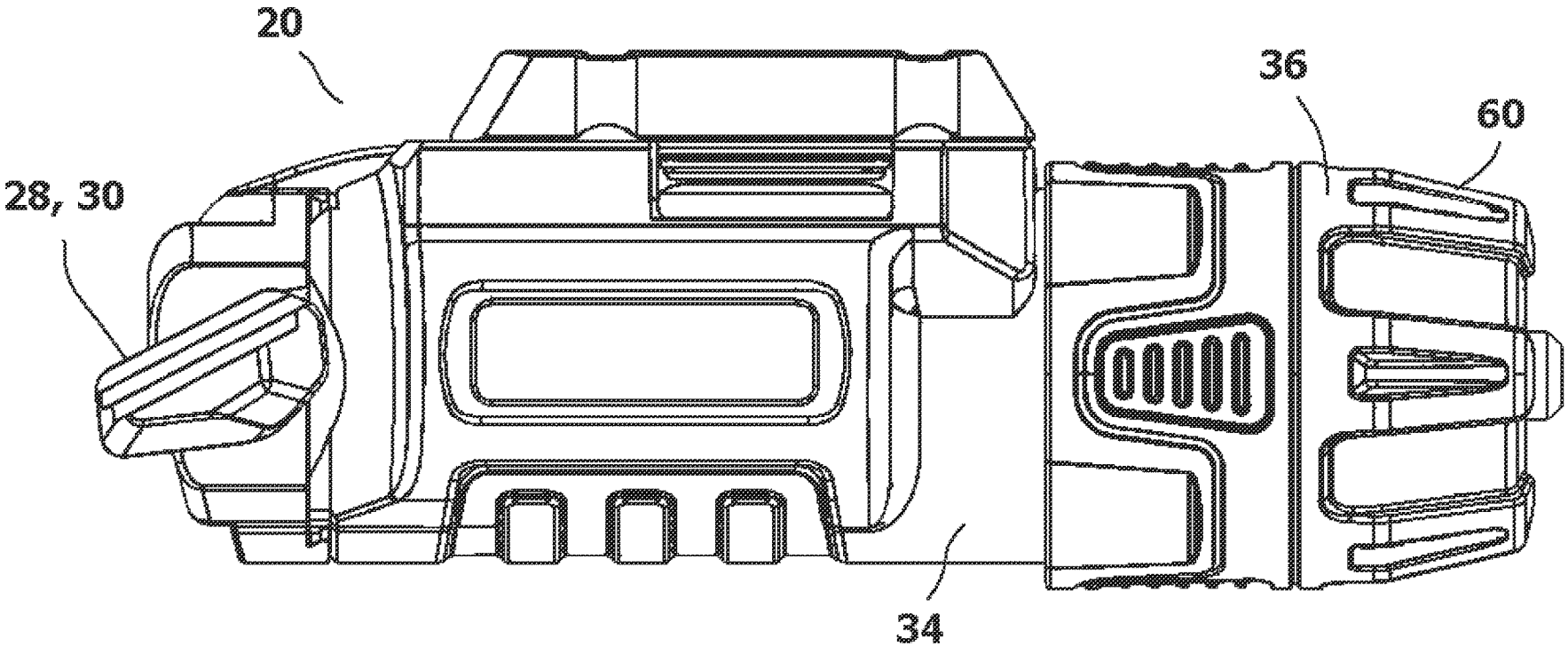
FIG. 2 is an enlarged view of the embodiment of the spray dispenser shown in FIG. 1.
Figure 3:
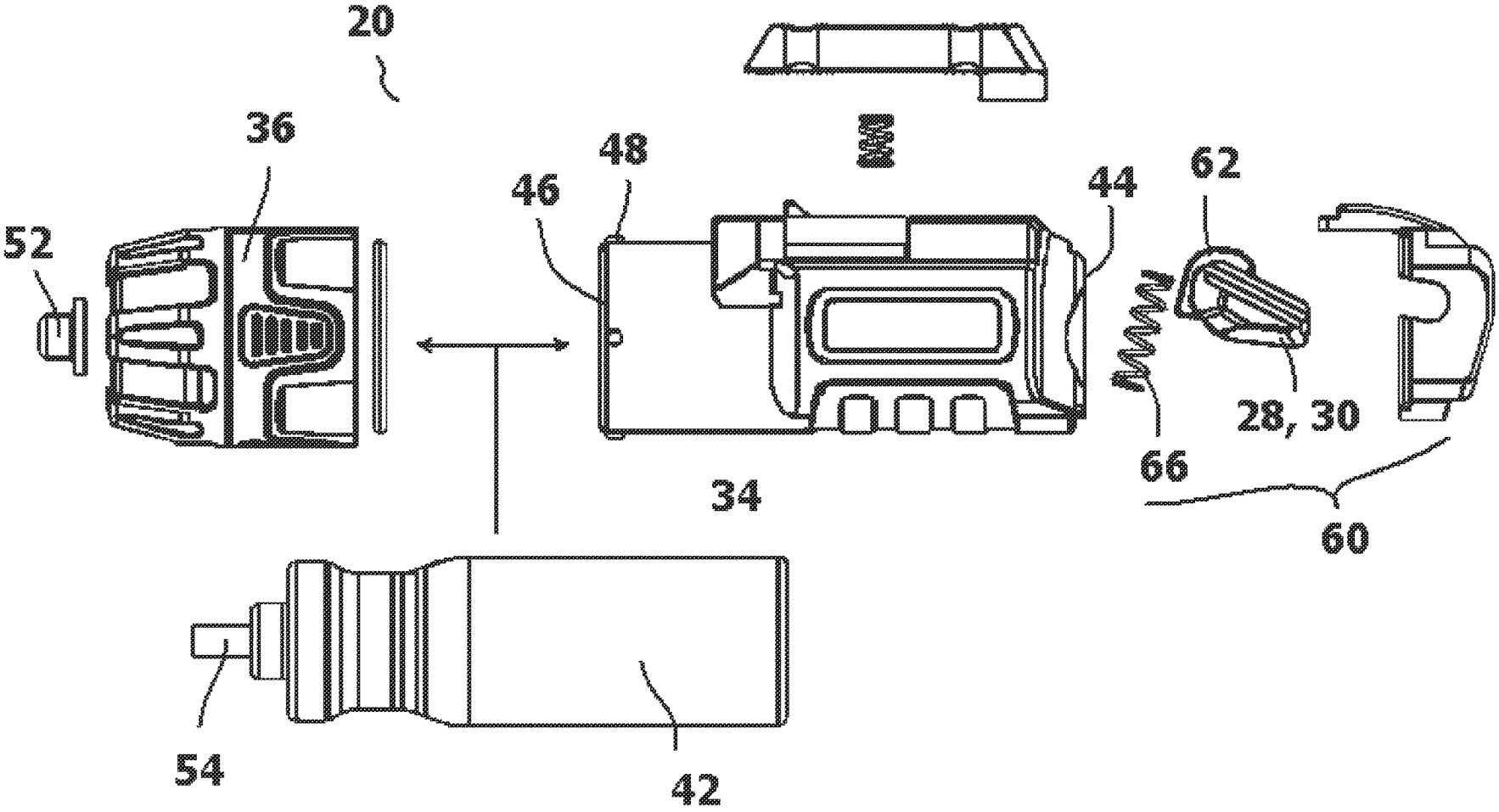
FIG. 3 is an exploded view of the embodiment of the spray dispenser shown in FIG. 2.
Figure 4:
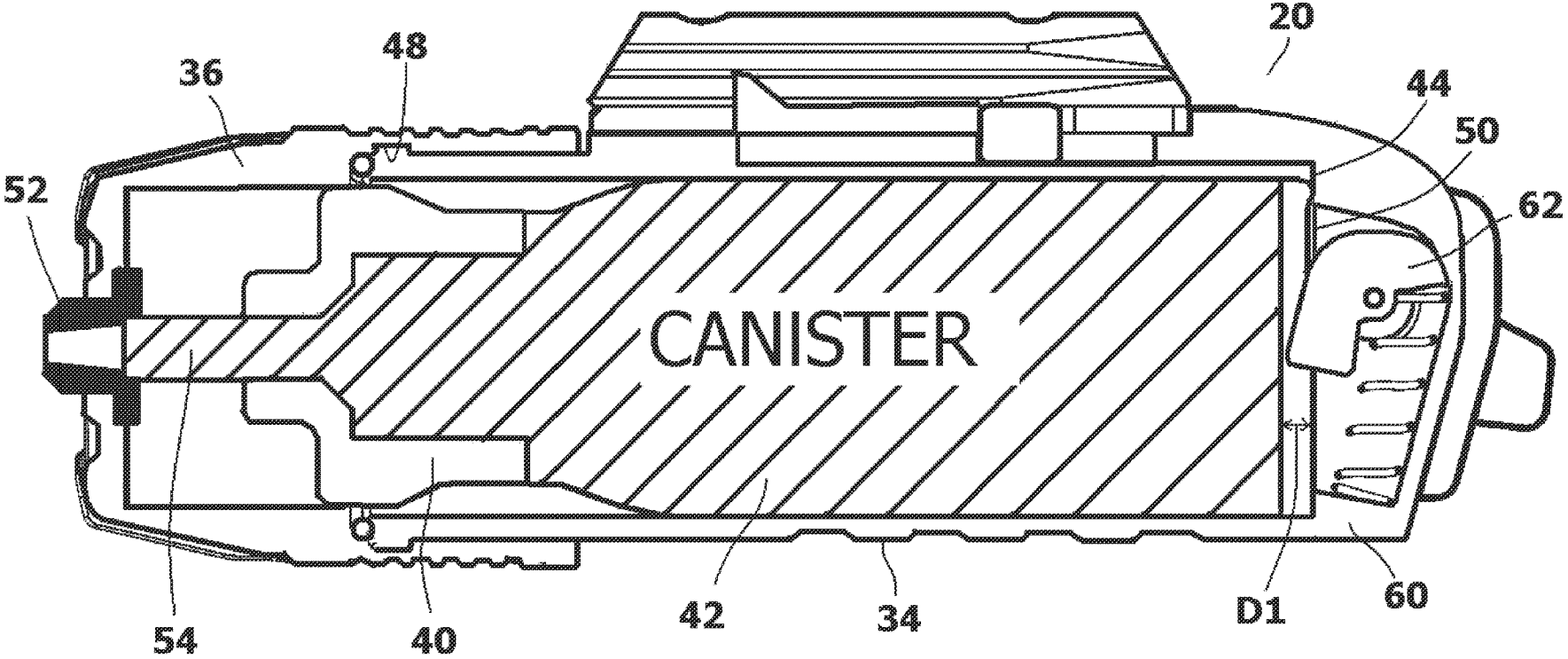
FIG. 4 is a cross-sectional view of the embodiment of the spray dispenser shown in FIG. 2.

Referring to FIG. 2, FIG. 3, and FIG. 4 in conjunction with FIG. 1, it can be seen that the spray dispenser 20 has a cylindrical body 34. The cylindrical body 34 has a removable end cap 36 that attaches to and elongates the cylindrical body 34. Together, the cylindrical body 34 and the end cap 36 define an internal chamber 40. The internal chamber 40 is shaped to receive and retain a pressurized canister 42 of the chemical irritant 22. The internal chamber 40 has a length that is slightly longer than that of the pressurized canister 42. As such, the pressurized canister 42 has some room to reciprocally move in the internal chamber 40. The pressurized canister 42 is a commercially available product that has a dispensing valve 54 at one end. The dispensing valve 54 releases the chemical irritant 22 from the pressurized canister 42 when depressed.

The cylindrical body 34 has an open end 46. A coupling 48, such as threads or a bayonet coupling, are provided proximate the open end 46. The coupling 48 is used to selectively connect the cylindrical body 34 to the end cap 36. The cylindrical body 34 also has a second end 44 that is opposite the open end 46. The second end 44 is configured to connect to an activation assembly 60, as is later explained.

A spray nozzle 52 is set into the end cap 36. The spray nozzle 52 is shaped and sized to receive a dispensing valve 54 on the pressurized canister 42. When the dispensing valve 54 of the pressurized canister 42 is pressed against the spray nozzle 52, the chemical irritant 22 leaving the pressurized canister 42 is released and is directed through the spray nozzle 52.

The first open end 46 of the cylindrical body 34 is large enough to receive the pressurized canister 42. Accordingly, the pressurized canister 42 can be inserted into the cylindrical body 34 by removing the end cap 36 to expose the first open end 46.

The second end 44 of the cylindrical body 34 has a smaller cam opening 50. The activation assembly 60 attaches to the second end 44 of the cylindrical body 34 over the cam opening 50. The activation assembly 60 has a cam 62 that extends into the internal chamber 40 of the cylindrical body 34 through the cam opening 50. The cam 62 can be selectively rotated into the internal chamber 40 of the cylindrical body 34 through the cam opening 50. When the cam 62 is rotated into the internal chamber 40, the cam 62 contacts the pressurized canister 42. If enough force is supplied to the rotation of the cam 62, the cam 62 can displace the pressurized canister 42 inside the internal chamber 40. As is shown in FIG. 4, the cam 62 rotates a distance D1 into the internal chamber 40. At this extended distance, the cam 62 contacts the pressurized canister 42 in the internal chamber 40 and displaces the pressurized canister 42 forward. Upon being displaced forward, the dispensing valve 54 is pressed against the spray nozzle 52. This activates the dispensing valve 54 and releases the chemical irritant 22 through the spray nozzle 52. The chemical irritant 22 is released until the manual rotation of the cam 62 is reversed.

Figure 5:
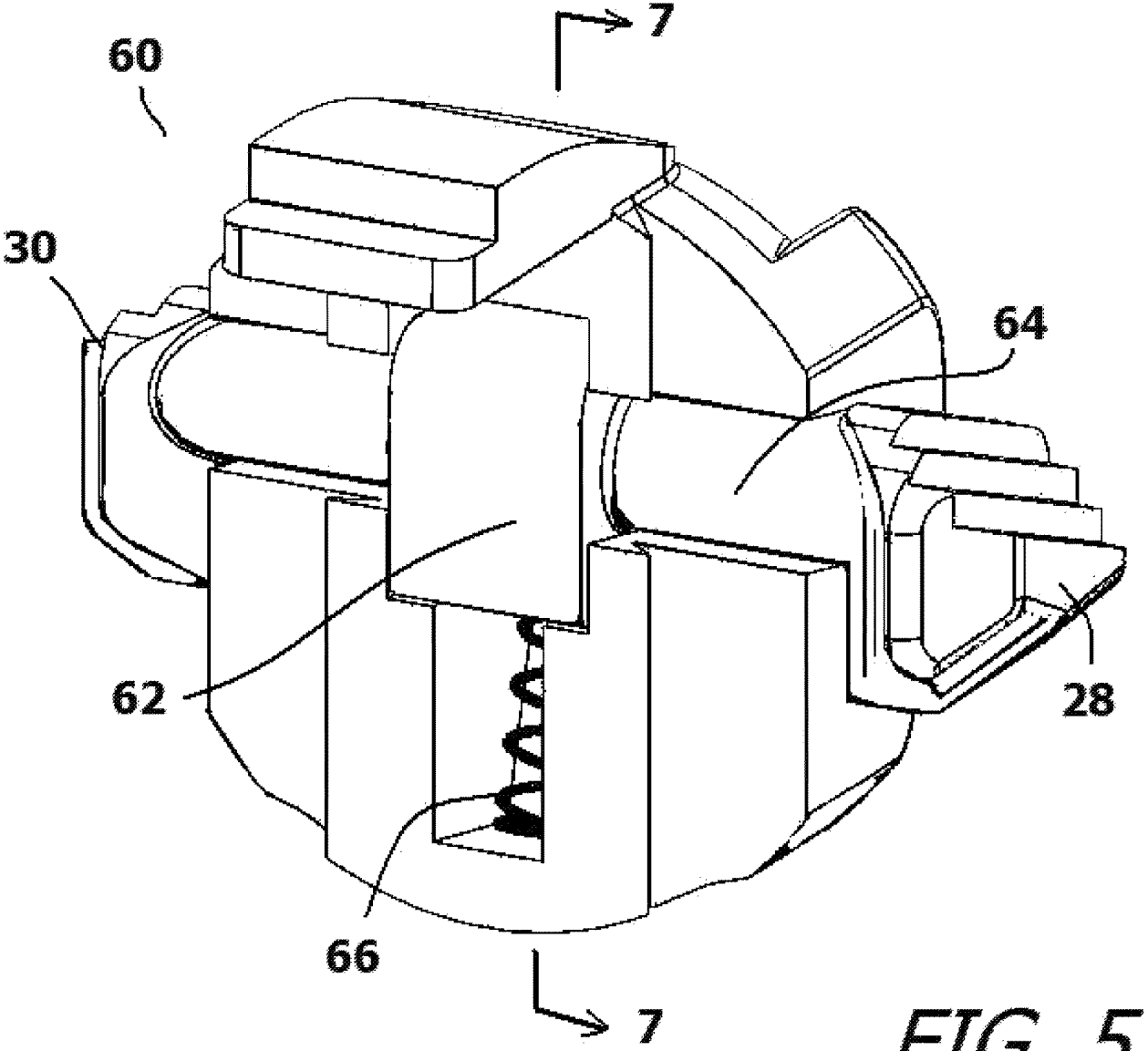
FIG. 5 is a perspective view of the activation assembly portion of the spray dispenser.
Figure 6:
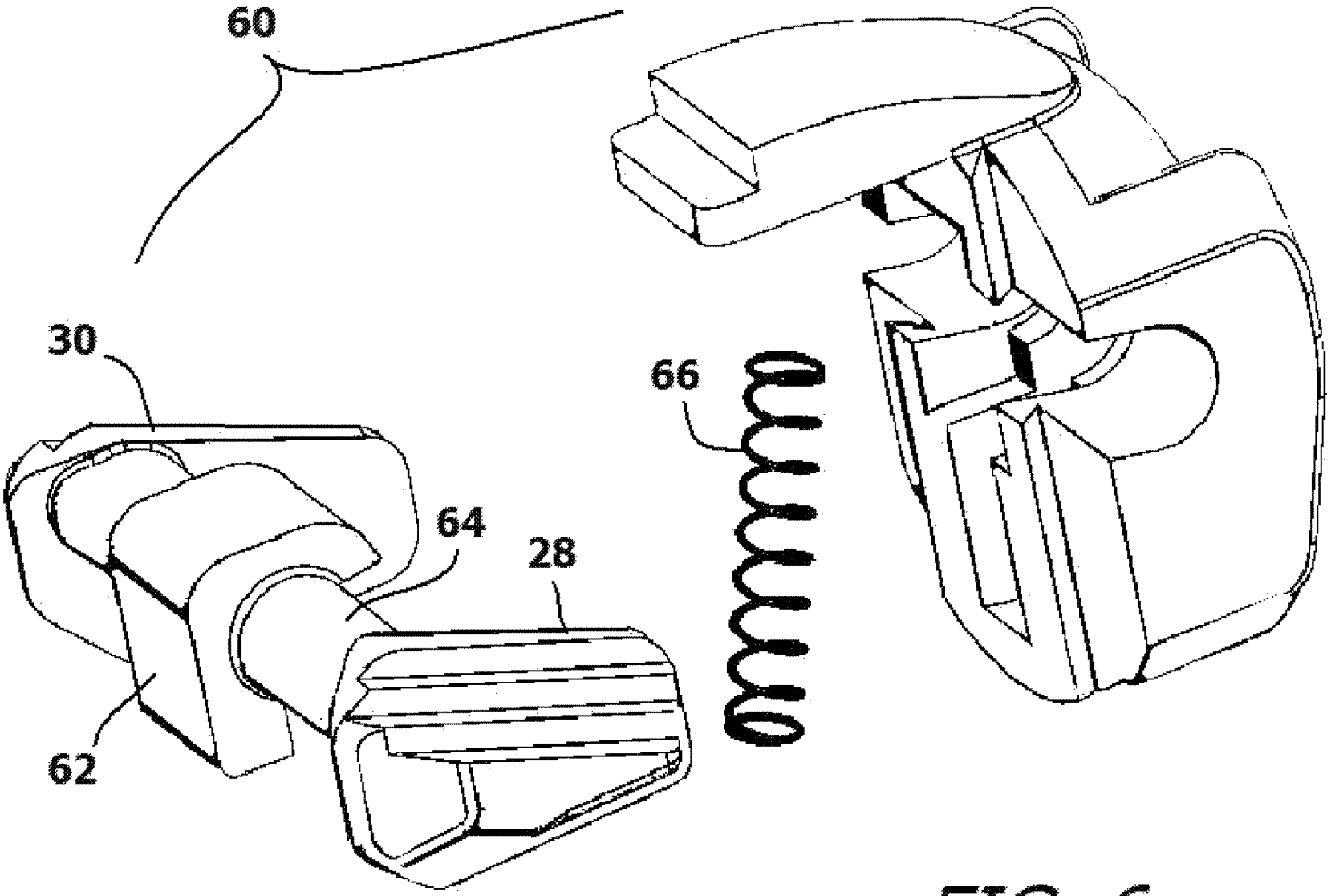
FIG. 6 is an exploded view of the activation assembly of FIG. 5.
Figure 7:
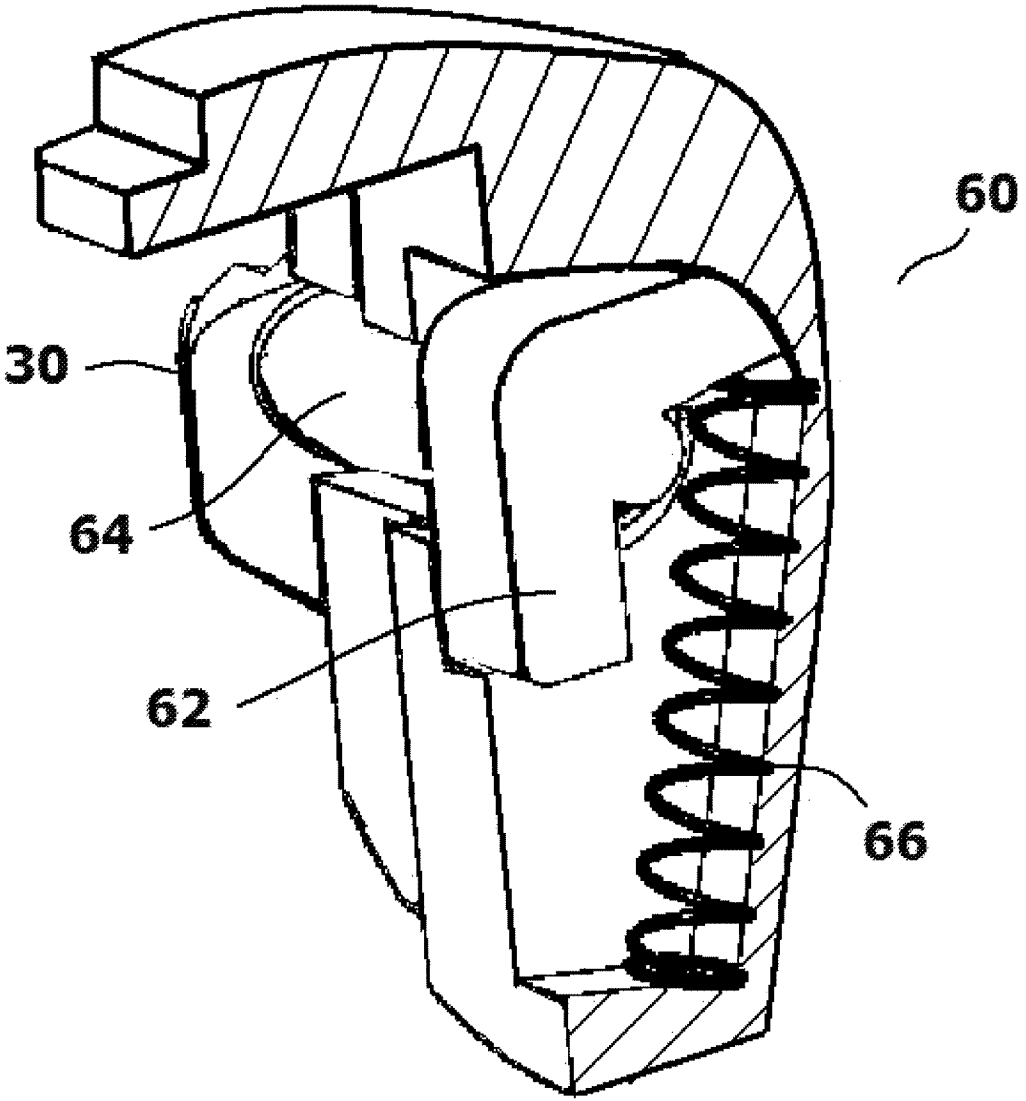
FIG. 7 is a cross-sectional view of the activation assembly shown in FIG. 5, viewed along section line 7-7.

Referring to FIG. 5, FIG. 6, and FIG. 7 in conjunction with FIG. 4, it will be understood that the activation assembly 60 attaches to the second end 44 of the cylindrical body 34. The activation assembly 60 containing the cam 62 is mounted on the center of an axle 64. The axle 64 has two opposing ends that are terminated with the finger levers 28, 30. When the finger levers 28, 30 are pressed downwardly, the axle 64 turns. The turning axle 64 rotates the cam 62 and causes the cam 62 to enter the internal chamber 40 though the cam opening 50. The activation assembly 60 also includes a return spring 66 that acts upon the cam 62. The return spring 66 biases the cam 62 into a retracted position where the cam 62 does not extend into the internal chamber 40. As a consequence, the finger levers 28, 30 must be depressed with enough force to overcome the resistance of the return spring 66 before the cam 62 will rotate into the internal chamber 40. Furthermore, as soon as manual force is removed from the finger levers 28, 30, the cam 62 will automatically return to a position where it does not enter the internal chamber 40.

Referring to all figures, it will be understood that to utilize the spray dispenser 20, the spray dispenser 20 is first loaded with a pressurized canister 42. This is accomplished by detaching the end cap 36 from the cylindrical body 34 and inserting the pressurized canister 42 into the open end 46 of the cylindrical body 34. Once the pressurized canister 42 is inserted, the end cap 36 is reattached. The loaded spray dispenser 20 is then attached to the mounting rail 16 of a handgun 10.

To spray chemical irritant 22, one or both of the finger levers 28, 30 is depressed. This causes the cam 62 in the activation assembly 60 to rotate into the cylindrical body 34. Once in the internal chamber 40 of the cylindrical body 34, the cam 62 displaces the pressurized canister 42 forward. This presses the dispensing valve 54 of the pressurized canister 42 against the spray nozzle 52. The spray nozzle 52 directs the chemical irritant 22 forward of the handgun 10.

It will be understood that the embodiment of the present invention that is illustrated and described is merely exemplary and that a person skilled in the art can make many variations to that embodiment. All such alternate embodiments are intended to be included within the scope of the present invention as defined by the appended claims.

What is claimed is:

1. A device for selectively dispensing material, said device comprising:

a cylindrical body having a first end and a second end, an end cap that connects to said first end of said cylindrical body, said end cap containing a spray nozzle, wherein said end cap and said cylindrical body define an internal chamber of a first length;

an axle having opposing ends and a center;

a cam affixed to said center of said axle, wherein said cam rotates with said axle when said axle rotates, wherein said cam has a first leg that extends from said axle in a first direction and a second leg that extends from said axle in a second direction, wherein said first direction is perpendicular to said second direction;

wherein said first leg of said cam selectively rotates from a first position outside said internal chamber to a second position at least partially inside said internal chamber when said axle rotates;

at least one finger lever coupled to said opposed ends of said axle, wherein said at least one finger lever rotates said axle and said cam when depressed, therein causing said cam to move from said first position to said second position; and a spring that presses against said second leg of said cam and biases said cam into said first position.

2. The device according to claim 1, further including a pressurized canister that is received in said internal chamber.

3. The device according to claim 2, wherein said pressurized canister is displaced in said internal chamber when said cam moves from said first position to said second position.

4. The device according to claim 1, further including a gun rail mount coupled to said cylindrical body, wherein said at least one finger lever rotates said axle and moves said cam into said second position when said at least one finger lever is rotated away from said gun rail mount.

5. The device according to claim 2, wherein said first end of said cylindrical body is open and is sized to enable the passage of said pressurized canister into said cylindrical body.

* * * * *